US006832934B1

(12) United States Patent
Zhang

(10) Patent No.: US 6,832,934 B1
(45) Date of Patent: Dec. 21, 2004

(54) HIGH SPEED ELECTRICAL CONNECTOR

(75) Inventor: George Huanyi Zhang, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/805,049

(22) Filed: Mar. 18, 2004

(51) Int. Cl.[7] ..... H01R 17/00
(52) U.S. Cl. ..... 439/660
(58) Field of Search ..... 439/79, 660, 635, 439/636

(56) References Cited

U.S. PATENT DOCUMENTS 4,173,387 A * 11/1979 Zell ..... 439/78
5,472,354 A * 12/1995 Chen et al. ..... 439/65
5,575,674 A * 11/1996 Davis et al. ..... 439/573
5,641,308 A 6/1997 Bixler et al.
6,250,932 B1 * 6/2001 Smith et al. ..... 439/61
6,331,122 B1 12/2001 Wu
6,488,543 B2 * 12/2002 Oliphant et al. ..... 439/329
D469,407 S 1/2003 Wu
6,592,401 B1 7/2003 Gardner et al.
6,648,682 B1 * 11/2003 Wu ..... 439/374
6,746,281 B1 * 6/2004 Zhang ..... 439/637

OTHER PUBLICATIONS

Pages 6 and 7 of "Serial Attached SCSI and Serial ATA compatibility white paper" by Intel Corp.
Page 4 of "Serial Attached SCSI: The Universal Enterprise Storage Connection" by LSI Logic Corp.

* cited by examiner

*Primary Examiner*—Briggitte R. Hammond
(74) *Attorney, Agent, or Firm*—Wei Te Chung

(57) ABSTRACT

An electrical connector (1) includes an elongated insulative housing (2) and a number of first and second contacts (3, 4). The insulative housing includes a first body portion (23) defining a first and a second pin receiving spaces (231, 232) to receive the second contacts and a second body portion (24). The second body portion includes a base (240), a tongue portion (241) extending forwardly from the base, a pair of end walls (243) located at opposite ends of the tongue portion and a strengthening wall (242) extending from the base and connecting with the pair of end walls. The tongue portion includes a first, a second and a third tongue sections (2413, 2414, 2415). The third tongue section has a thickness greater than each of those of the first and the second tongue sections. The first contacts are grouped into a first, a second and a third sets of first contacts (31, 32, 33) respectively received in the second body portion of the housing.

17 Claims, 8 Drawing Sheets

HIGH SPEED ELECTRICAL CONNECTOR

BACKGROUND OF THE INVENTION

1. Field of the Invention

The present invention generally relates to an electrical connector, and particularly to a high speed Serial Attached SCSI (Small Computer System Interface) (SAS) connector mounted on a printed circuit board.

2. Description of Related Art

Parallel ATA (Advanced Technology Attachment) and parallel SCSI are two dominant disk interfaces technologies today. The parallel ATA disks are widely used in desktop PCs and mobile PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal transmitting speed, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not fired to a particular clock speed.

Serial ATA (SATA) is a serial version of ATA, which is expected to be a replacement for parallel ATA. U.S. Pat. No. 6,331,122 discloses a type of SATA receptacle connector for being mounted on a printed circuit board. The receptacle connector has two receiving cavities defined in an insulative housing thereof and two sets of conductive contacts respectively used for power and signal transmission installed in the insulative housing. U.S. Pat. No. D469,407 discloses an electrical connector assembly with a SATA plug connector as a part thereof. The plug connector has a first and a second generally L-shaped tongue plates receiving two sets of terminals for electrically connecting the conductive contacts as the tongue plates are inserted into the respective receiving cavities of the receptacle connector.

SAS is a successor to the parallel SCSI and is also based on serial technology. Besides the advantage of higher speed signal transmission, another most significant advantage is the SAS interface will also be compatible with SATA drives. In other words, the SATA plug connector can plug directly into an SAS receptacle connector if supported in the system. By this way, the system builders are flexible to integrate either SAS or SATA devices and slash the costs associated with supporting two separate interfaces.

The SAS plug connector has generally the same configuration as the SATA plug connector except that the first and the second tongue plates of the SATA plug connector are merged in a large one of the SAS plug connector by a third tongue plate, and a third set of signal contacts are assembled to a second surface of the third tongue plate opposing to a first surface where two sets of contacts have already being assembled. When the SAS plug connector mates with the SAS receptacle connector, the united first, second and the third tongue plates are inserted into a receiving cavity of the receptacle connector. However, the total length of the tongue plates is relatively long, the ability of resisting an inadvertent bending force of the SAS plug connector is relatively weak. Thus, a strengthened SAS plug connector is highly desired to overcome the disadvantages of the related art.

BRIEF SUMMARY OF THE INVENTION

Accordingly, it is an object of the present invention to provide an electrical connector, which can provide a reliable electrical connection with a complementary connector.

In order to achieve the above-mentioned object, an electrical connector in accordance with the present invention comprises an insulative housing and a plurality of first and second contacts. The insulative housing comprises a first body portion defining a first and a second pin receiving spaces to receive the second contacts and a second body portion. The second body portion comprises a base, a tongue portion extending forwardly from the base, a pair of end walls extending forwardly from the base and a strengthening wall extending from the base and connecting with the pair of end walls. The tongue portion comprises a first, a second and a third tongue sections connecting with the first and the second tongue sections. The thickness of the third tongue section is greater than each of those of the first and the second tongue sections. The first contacts are grouped into a first set, a second set and a third set of first contacts respectively received in the second body portion. The first and the second sets of first contacts, the third set of first contacts are arranged in two rows.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
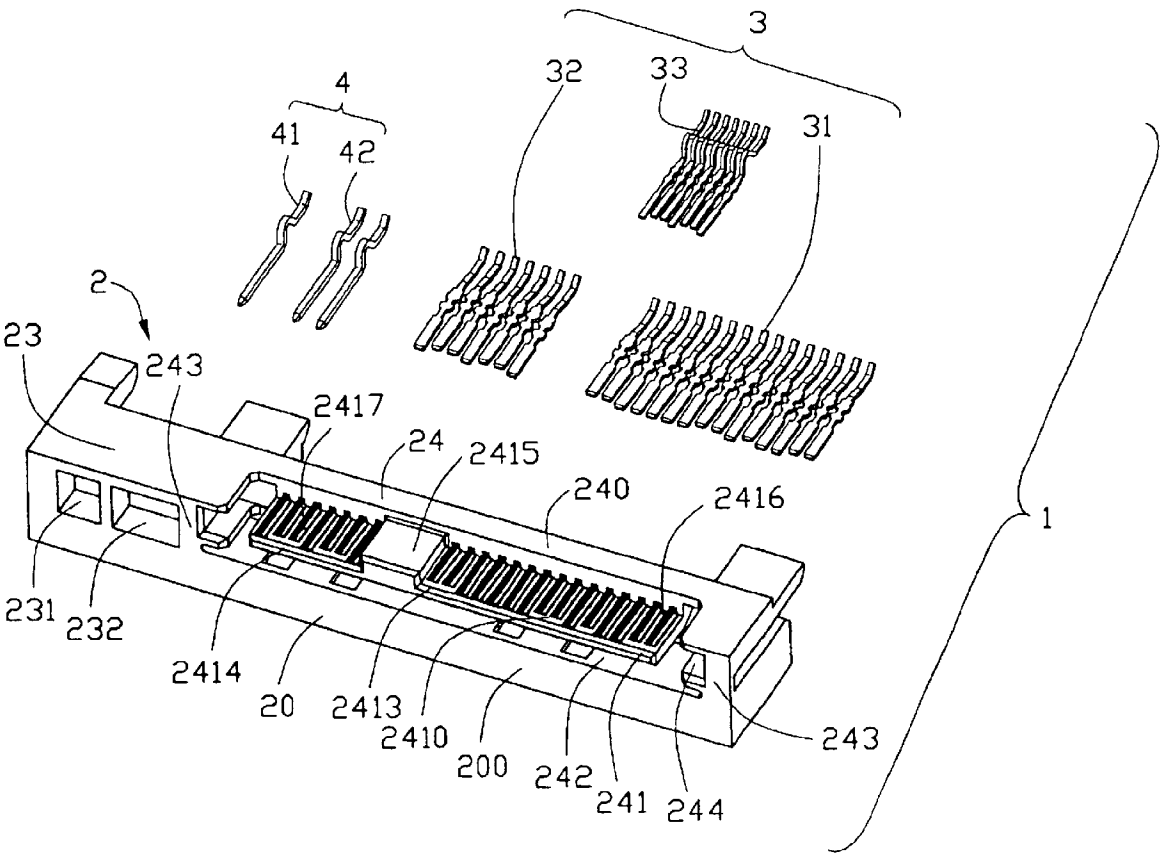
FIG. 1 is an exploded, perspective view of an electrical connector in accordance with the present invention.
Figure 2:
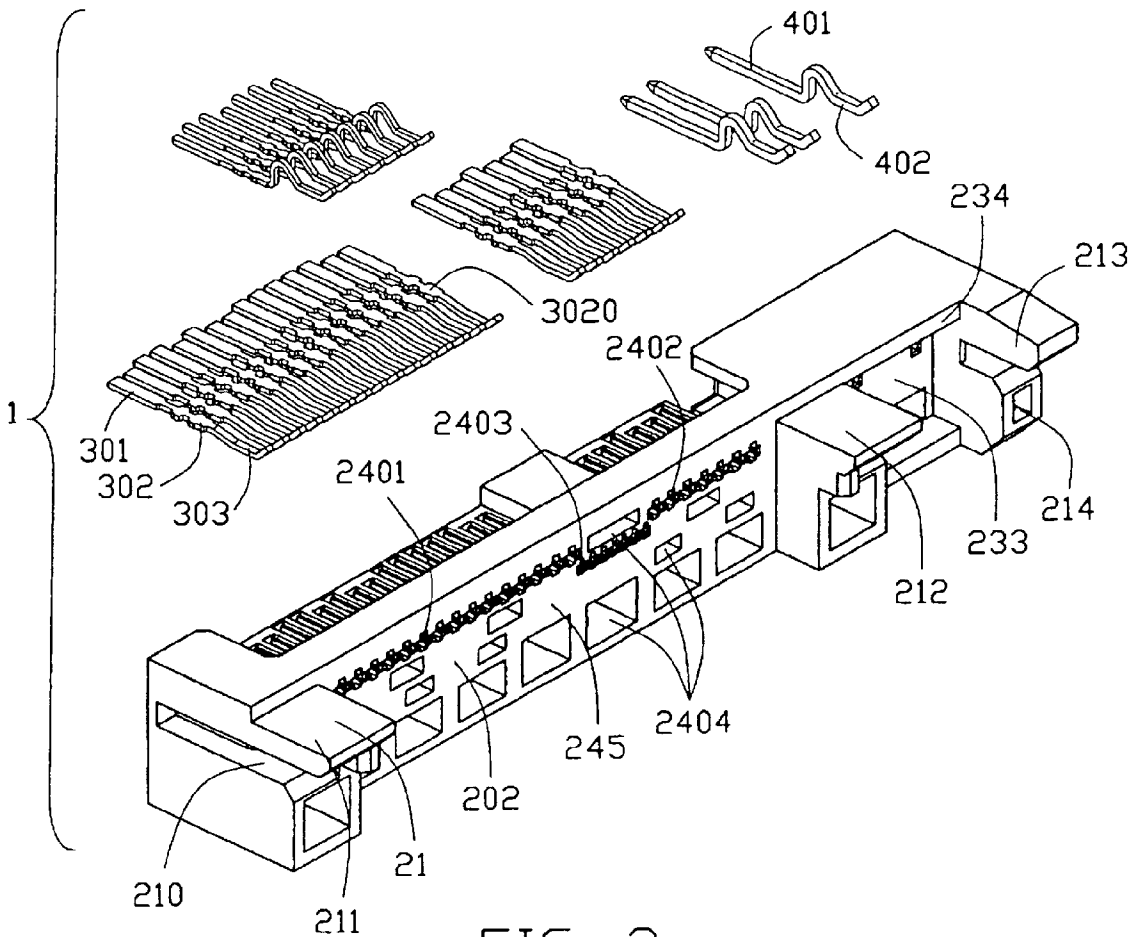
FIG. 2 is a view similar to FIG. 1, but taken from a different aspect.
Figure 3:
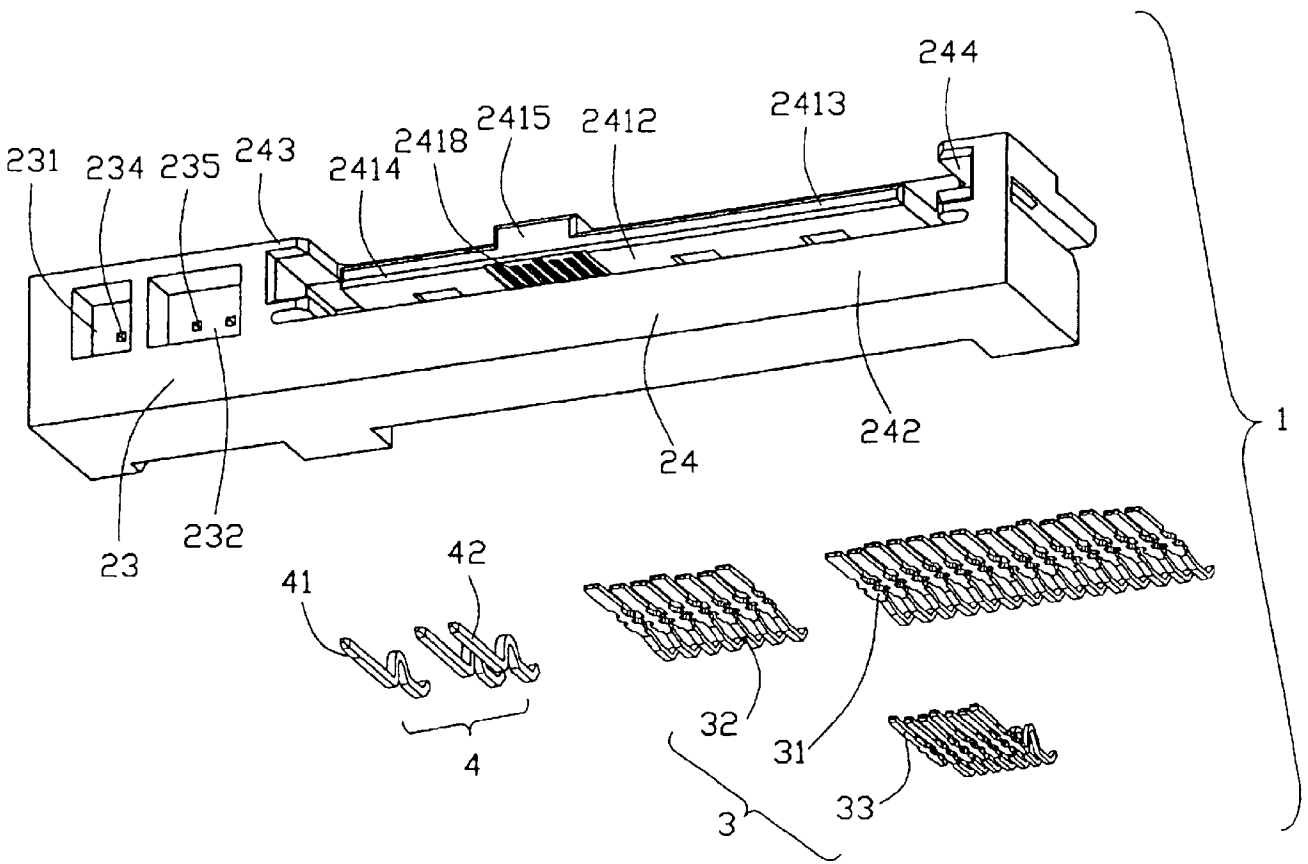
FIG. 3 is a view similar to FIG. 1, but taken from another different aspect.
Figure 4:
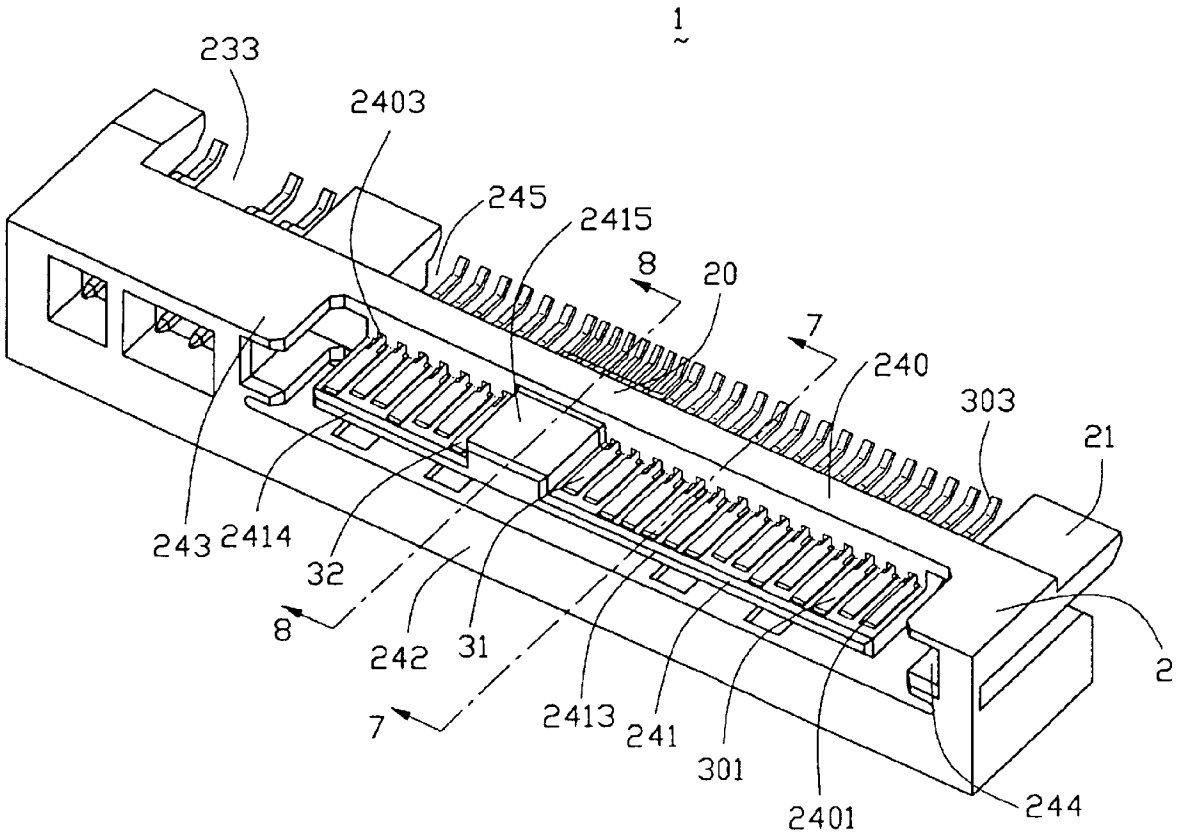
FIG. 4 is an assembled, perspective view of FIG. 1.
Figure 5:
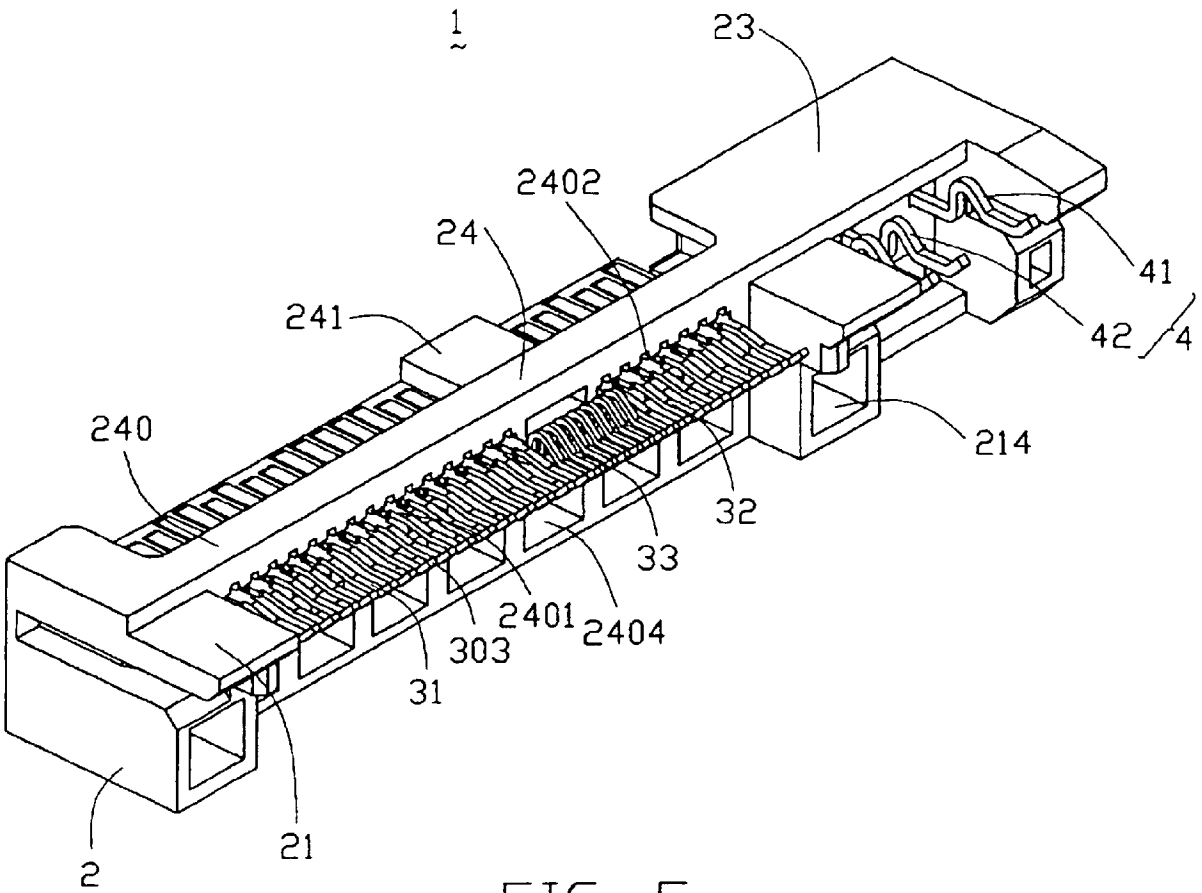
FIG. 5 is an assembled, perspective view of FIG. 2.
Figure 6:
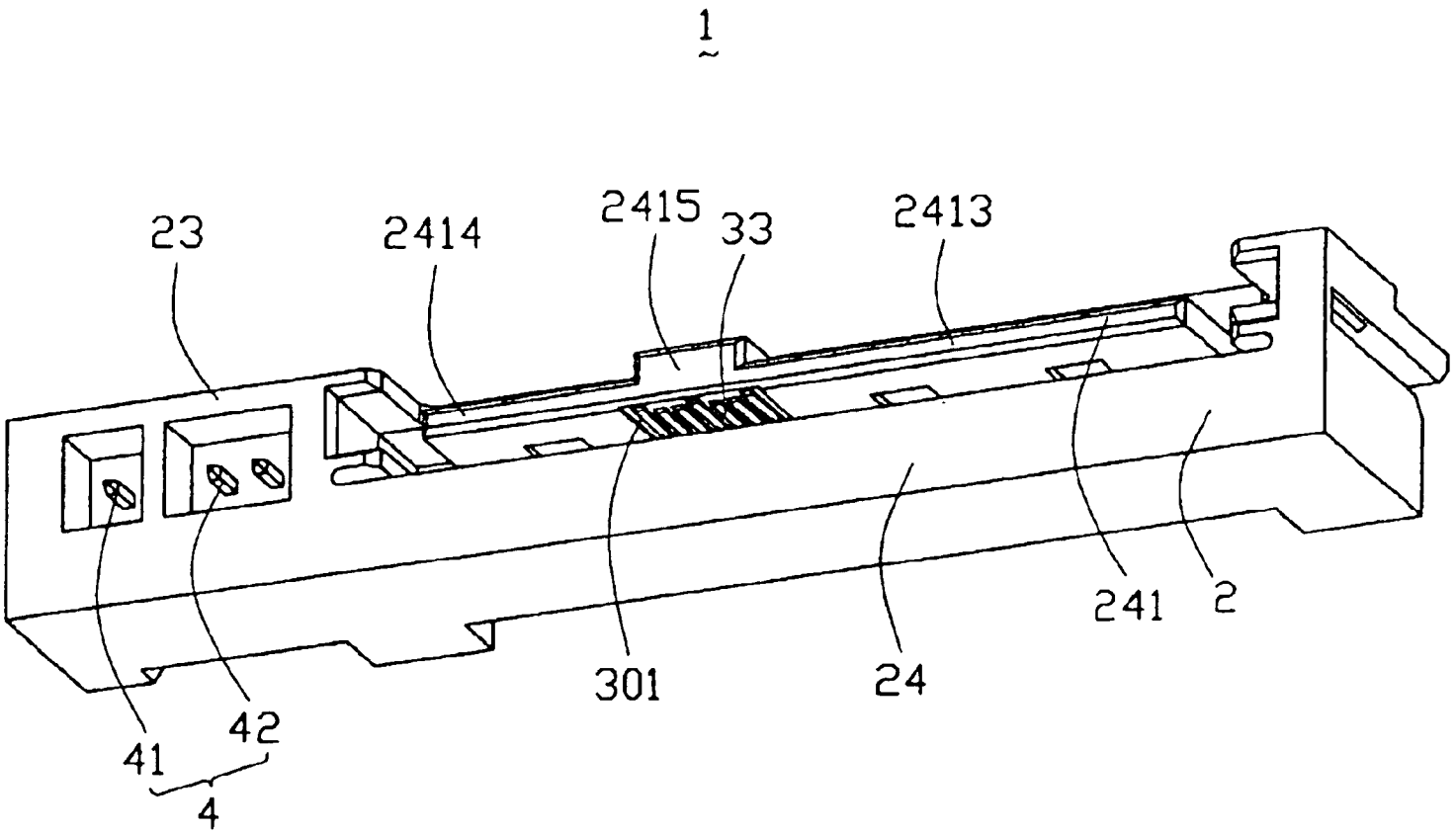
FIG. 6 is an assembled, perspective view of FIG. 3.

Reference will now be made to the drawing figures to describe the present invention in detail.

With reference to FIGS. 1–6, an electrical connector 1 of the present invention comprises an elongated, insulative housing 2 and a plurality of first and second contacts 3, 4 received in the housing 2.

The elongated, insulative housing 2 comprises a longitudinal base portion 20 comprising a mating face 200 and an opposite mounting face 202, and a plurality of dividing partitions 21 extending rearwardly from the mounting face 202 of the base portion 20. The dividing partitions 21 include a first, a second and a third dividing walls 211, 212, 213 which divide the longitudinal base portion 20 into a first body portion 23 and a second body portion 24 integrally formed with the first body portion 23. Each dividing partition 21 defines a slit 210 in a middle portion thereof for sandwiching a printed circuit board and a weight-reducing slot 214 in a lower portion thereof for saving material.

The first body portion 23 defines a first and a second pin receiving spaces 231, 232 extending from the mating face 200 toward the mounting face 202 of the base portion 20. A plurality of first and second pin receiving passages 234, 235 are defined through the first body portion 23 and respectively communicate with the first and the second pin receiving spaces 231, 232.

The second body portion 24 is partially cutoff to form a base 240, a tongue portion 241 extending forwardly from a front surface of the base 240, a strengthening wall 242 extending forwardly from the base 240, and a pair of opposite end walls 243 connecting with base 240 and the strengthening wall 242. Each end wall 243 is defined with a U-shaped guiding space 244 for guiding an insertion of a complementary connector (not shown). The tongue portion 241 includes opposite first and second surfaces 2410, 2412 and forms a first tongue section 2413 adjacent to one end wall 243, a second tongue section 2414 adjacent to the other end wall 243, and a third tongue section 2415 connecting with both the first and the second tongue sections 2413, 2414. It can be seen that the thickness of the third tongue section 2415 is greater than each of those of the first and the second tongue sections 2413, 2414 which have the same thickness as each other. The first and the second tongue sections 2413, 2414 are respectively slotted with a plurality of first and second passages 2416, 2417 in the first surface 2410 of the tongue portion 241. The third tongue section 2415 is slotted with a plurality of third passages 2418 in the second surface 2412 of the tongue portion 241. The base 240 defines a plurality of first, second and third passageways 2401, 2402, 2403 respectively communicating with the first, the second and the third passages 2416, 2417, 2418 of the tongue portion 241. The third passageways 2403 are arranged in one row and are located lower than the first and the second passageways 2401, 2402 which are arranged on the same row. A plurality of weight-reducing slots 2404 are respectively defined in the base 240 and the third tongue portion 2415 for material saving and weight reduction.

Figure 7:
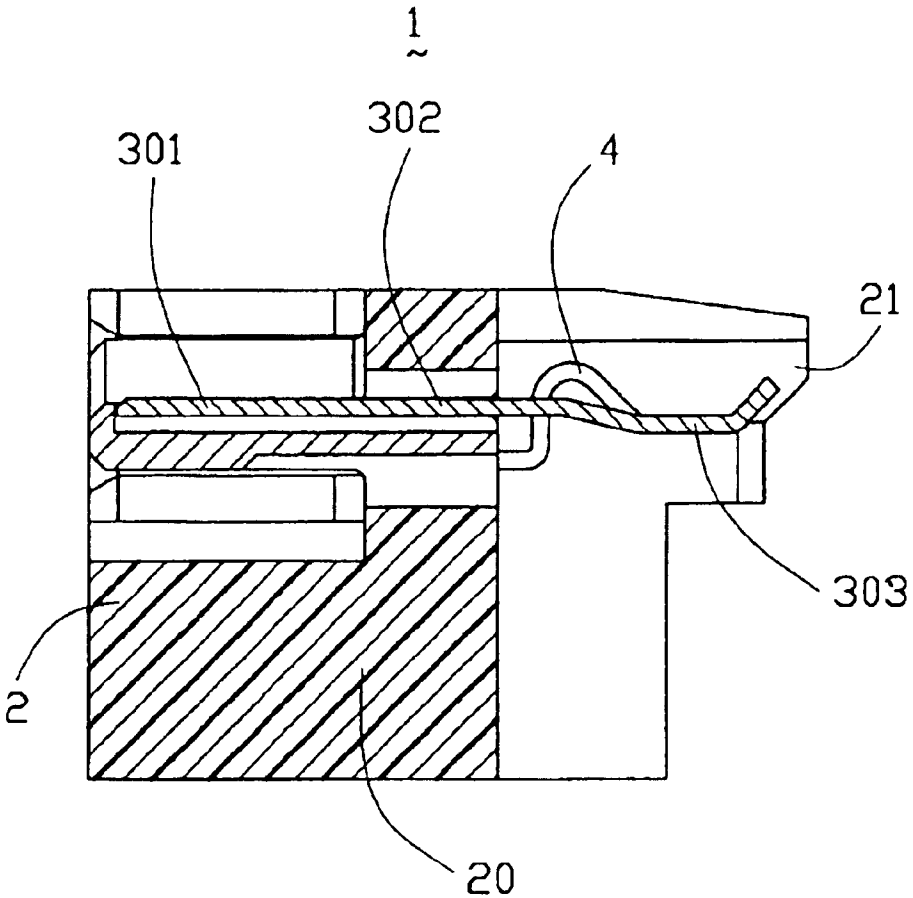
FIG. 7 is a cross-sectional view of FIG. 4 taken along line 7—7.
Figure 8:
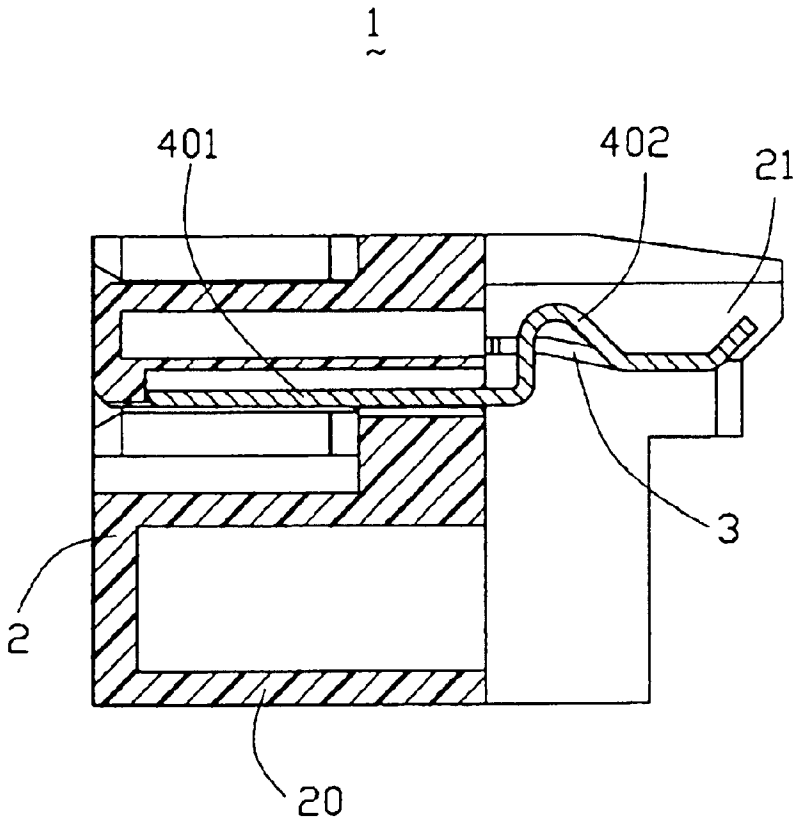
FIG. 8 is a cross-sectional view of FIG. 4 taken along line 8—8.

Turn to FIGS. 1–6 in conjunction with FIGS. 7–8, the first contacts 3 include a first set of first contacts 31 mainly for power transmission, a second set of first contacts 32 and a third set of first contacts 33 both for signal transmission. The first, the second and the third sets of first contacts 31, 32, 33 are respectively protrude through the first, the second and the third passageways 2401, 2402, 2403 of the base 240 and are received in the first, the second and third passages 2416, 2417, 2418 of the tongue portion 241. The three sets of first contacts 3 are substantially identical in structure, and only one of first contacts 3 is illustrated here for simplicity. Each first contact 3 comprises a contacting portion 301, a board retention portion 303 extending oppositely to the contacting portion 301, and a housing retaining portion 302 interconnecting the contacting portion 301 and the board retention portion 303. The contacting portion 301 has a flat shape and is exposed in a corresponding passage of the tongue portion 241 of the housing 2 for electrically engaging with a corresponding terminal of the complementary connector. The board retention portion 303 is configured for surface mounting on the printed circuit board and exposed in a second tail receiving section 245 defined between the first and the second dividing walls 211, 212. The housing retaining portion 302 provides a barb 3020 on a lateral edge for interfering within a corresponding passageway of the base 240.

The second contacts 4 are mainly for power transmission and are grouped into a first set of second contacts 41 and a second set of second contacts 42. The two sets of second contacts 4 are substantially identical in structure, and only one of the second contacts 4 is illustrated here for simplicity. Each second contact 4 comprises a pin-contacting portion 401 and a curved tail portion 402 for surface mounting on the printed circuit board. The first and the second sets 41, 42 are respectively inserted into the first and the second pin receiving passages 234, 235. The pin-contacting portions 401 of the first and the second sets of second contacts 41, 42 are respectively exposed into the first and the second pin receiving spaces 231, 232 and the tail portions 402 are exposed into a first tail receiving section 233 defined between the second and the third dividing walls 212, 213.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector for mounting on a printed circuit board, comprising:

an insulative housing comprising a longitudinal base, a tongue portion extending forwardly from the base and a pair of end walls extending forwardly from the base, the tongue portion comprising a first tongue section, a second tongue section and a third tongue section connecting with the first and the second tongue sections, the thickness of the third tongue section being greater than each of those of the first and the second tongue sections; and a plurality of contacts respectively received in the insulative housing; wherein the contacts are grouped into a first, a second and a third set of contacts respectively received in the first, the second and the third tongue sections; wherein the tongue portion comprises a first surface and an opposite second surface both extending in a longitudinal direction of the tongue portion, and wherein the first and the second sets of contacts are located in the first surface of the tongue portion and the third set of contacts are located in the second surface of the tongue portion.

2. The electrical connector as described in claim 1, further comprising a strengthening wall extending forwardly from the base and connecting with the pair of end walls.

3. The electrical connector as described in claim 1, wherein each end wall defines a U-shaped guiding space for guiding an insertion of a complementary connector.

4. The electrical connector as described in claim 1, further comprising a first and a second dividing walls extending from the base opposite to the pair of end walls.

5. The electrical connector as described in claim 4, wherein each dividing wall defines a slit in a middle portion for engaging with a printed circuit board.

6. The electrical connector as described in claim 1, each contact comprises a contacting portion, a board retention portion extending outwardly from the housing, and a housing retaining portion connecting the contacting portion and the board retention portion.

7. The electrical connector as described in claim 6, wherein the board retention portions of the first and the second sets of contacts are arranged on the same row, and the board retention portions of the third set of contacts are arranged on a second row.

8. The electrical connector as described in claim 6, wherein the board retention portions of the contacts are configured for surface mounting on the printed circuit board.

9. The electrical connector as described in claim 6, wherein the board retention portions of the contacts are exposed between the first and the second dividing walls.

10. The electrical connector as described in claim 6, wherein the first and the second tongue sections define a plurality of first and second passages in the first surface of the tongue portion to receive the contacting portions of the first and the second sets of contacts, and the third tongue section defines a plurality of third passages in the second surface of the tongue portion to receive the contacting portions of the third set of contacts.

11. The electrical connector as described in claim 6, wherein the base of the tongue portion defines a plurality of first, second and third passageways corresponding to the first, the second and the third passages of the tongue portion to receive the housing retaining portions of the first, the second and the third sets of contacts, respectively.

12. An electrical connector for mounting on a printed circuit board, comprising:

an insulative housing comprising a first body portion and a second body portion integrally formed with the first body portion, the first body portion defining a first and a second pin receiving spaces, the second body portion comprising a base, a tongue portion extending forwardly from the base and a pair of end walls extending forwardly from the base, the tongue portion comprising a first, a second and a third tongue sections connecting with the first and the second tongue sections;

a plurality of first contacts respectively received in the second body portion;

a first and a second sets of second contacts respectively received in the first and the second pin receiving spaces; wherein the first contacts comprise a first, a second and a third set of first contacts respectively received in the first, the second and the third tongue sections, and wherein the first and the second sets of first contacts are arranged on the same row and the third set of first contacts are arranged on a second row; wherein the thickness of the third tongue section is greater than each of those of the first and the second tongue sections.

13. The electrical connector as described in claim 12, wherein the housing further comprises a plurality of rearwardly extending dividing walls.

14. The electrical connector as described in claim 12, wherein the second body portion forms a strengthening wall extending forwardly from the base and connecting with the pair of end walls.

15. An electrical connector comprising:

an insulative housing comprising a horizontal longitudinal base with a tongue portion and a pair of end walls by two sides of the tongue portion commonly extending from said base, said tongue portion defining first, second and third sections in sequence along a longitudinal direction thereof, said first and third sections defining a mating face facing in a first direction, and said second section defining another mating face facing in a second direction opposite to said first direction;

first, second and third sets of contacts disposed in the first, second and third sections, respectively, each of said first, second and third sets of contacts defining at front ends thereof mating contact portions exposed to an exterior in the corresponding directions, respectively, while said each of said first, second and third sets of contacts further defining at rear ends thereof tail portions; wherein said tail portions of said first, second and third sets of contacts are all located on a same plane for commonly surface mounting to a printed circuit board wherein, a thickness of said second section is larger than those of the first and third sections.

16. The connector as described in claim 15, wherein said plane is located at a level between said mating face and said another mating face in a vertical direction.

17. The connector as described in claim 15, wherein said base is uninterrupted along said longitudinal direction.

* * * * *